United States Patent [19]

Kopal et al.

[11] 3,943,732

[45] Mar. 16, 1976

[54] SHOCKLESS NEEDLES PARTICULARLY FOR CIRCULAR KNITTING MACHINE

[75] Inventors: Jaroslav Kopal, Liberec; Milos Jansa, Brno; Jaroslav Deiss, Tisnov, all of Czechoslovakia

[73] Assignee: Vyzkumny a vyvojovy ustav Zavodu vseobecneho strojirenstvi, Brno, Czechoslovakia

[22] Filed: Mar. 14, 1974

[21] Appl. No.: 451,185

Related U.S. Application Data

[62] Division of Ser. No. 102,333, Dec. 29, 1970, abandoned.

[30] Foreign Application Priority Data

Dec. 29, 1969 Czechoslovakia ..... 8557-69

[52] U.S. Cl. ..... 66/123

[51] Int. Cl.[2] ..... D04B 35/02

[58] Field of Search ..... 66/123, 124, 121

[56] References Cited

UNITED STATES PATENTS

| | | | |
|---|---|---|---|
| 433,747 | 8/1890 | Scott | 66/124 |
| 468,513 | 2/1892 | Gilbert | 66/124 X |
| 626,114 | 5/1899 | Vernon | 66/124 |
| 668,833 | 2/1901 | Gilbert | 66/123 X |
| 1,077,600 | 11/1913 | Egly | 66/124 |
| 1,154,169 | 9/1915 | Bosworth | 66/48 X |
| 1,178,682 | 4/1916 | Scott | 66/124 |
| 1,184,526 | 5/1916 | Harley | 66/123 |
| 1,221,806 | 4/1917 | Scott | 66/124 X |

*Primary Examiner*—Wm. Carter Reynolds

[57] ABSTRACT

A shockless needle for circular knitting machines wherein the needle is slidably mounted in a trick, and is provided with a butt which periodically engages a needle-sliding cam. The butt extends laterally from the needle in a direction at least substantially at right angles to the longitudinal axis of the needle, the needle being pre-sprung in the location of the butt so that the opposite sides of the needle at such location engage the corresponding confronting sides of the trick.

1 Claim, 1 Drawing Figure

SHOCKLESS NEEDLES PARTICULARLY FOR CIRCULAR KNITTING MACHINE

Figure 1:
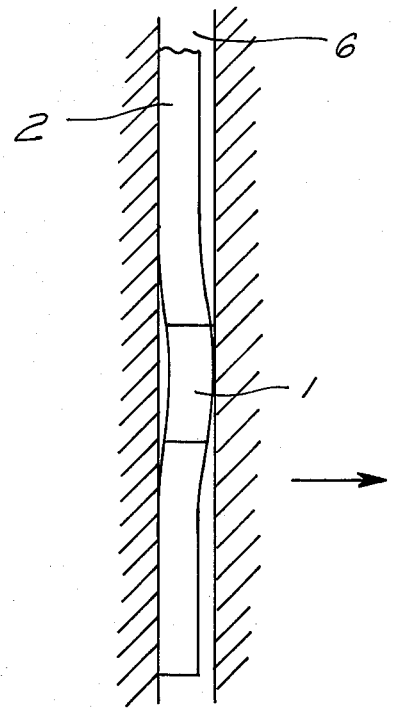

This is a division, of application Ser. No. 102,333 filed Dec. 29, 1970, now abandoned.

This invention relates to shockless needles for circular knitting machines and deals with the problem of reducing the impact force acting on the needle caused by inertia or by the entraining force of the yarn being knitted.

The conventional needles of the state of the art generally have the same thickness throughout. The needles are recessed in their lower parts for the purpose of springing the needle in the trick to obtain some resistance to avoid the needles falling out from the tricks. The problem of impact shocks is eliminated only if, in the place where the needle butt strikes the cam, there is a certain angle, such angle depending upon experience. In such a construction, there occurs in these places a sudden increase of acting forces, and a local wear of the cam takes place. Structural failure can eventually occur at the site of maximum acceleration of the needle or due to the resistance raised by the yarn. This fact limits the increase in the output of circular knitting machines, both from the point of view of actual output by the increase in the speed of revolution and with respect to the increase of the number of the cam systems of the machine.

The above-mentioned disadvantages and shortcomings are eliminated to a certain degree by this invention, the principle of which is that the needles, which are individually slidable in the tricks, are, at the location of the butts, provided with a pre-sprung portion serving to decrease the needle stiffness and increase the clearance between the butt portion of the needle and trick walls.

The advantage of shockless needles for circular knitting machines according to this invention is that they ensure a decrease in the stress of the needle and in the cam track, which permits decreasing the wear of both mentioned parts. At the same time, this embodiment enables a substantial increase of the machine output either by the increase of speed of the machine or by the increase of the number of the cam systems in the machine.

An exemplary embodiment of the invention is illustrated in the drawing, where the FIGURE illustrates an embodiment wherein a pre-sprung needle is located at the trick.

Shockless needles for circular knitting machines constructed in accordance with the invention constitute a solution of the problem of decreasing the impact force caused by inertia or the entraining force of the yarn. In the embodiment of the invention the location of the butt 1 is located on the side of the needle 2, there being a pre-sprung needle 2 which is slidable in the trick 6 with a clearance between the side of the needle 2 and the side of the trick 6 in the place of the lateral bulging pre-sprung portion that includes the entire cross section of the needle shank and butt 1 so that the needle 2 springs in the zone of the butt 1 when striking the cam. This increases the yielding character of the needle 2 in the place where there is a force due to the impact of the butt 1 on the cam, which leads to increased flexibility. For example, when the needle 2 mounted on a needle carrier rotating in the direction of the arrow, enters the cam track, the created force is absorbed over a longer time interval, i.e., its magnitude decreases, which enables either to increase the speed of revolution of the machine or to use a higher number of the cam systems. A side of the laterally bulging pre-sprung portion, which includes the butt 1, is in sliding contact with the confronting side wall of the trick as depicted in the FIGURE. The laterally bulging pre-sprung portion is resiliently supported by portions of the shank spaced in opposite directions axially of the shank from the laterally bulging pre-sprung portion, depicted above and below the butt 1 in the FIGURE, engaging the trick side wall opposite to that which is engaged by the butt.

Shockless needles for circular knitting machines according to this invention can be advantageously used in the design of circular knitting machines enabling maximum decrease of the striking force acting on the needle during the machine operation. The mentioned solution can be used also in flat bed knitting machines. In both cases it is possible to use it also with other auxiliary elements such as sinkers, jacks, etc.

Although the invention is illustrated and described with reference to one preferred embodiment thereof, it is to be expressly understood that it is in no way limited to the disclosure of such a preferred embodiment but is capable of numerous modifications within the scope of the appended claims.

What we claim is:

1. In a circular knitting machine having knitting needles with elongated shanks slidably mounted in tricks in a rotatable needle carrier, each of said needles having an outwardly protruding integral butt for engagement with needle sliding cams on the circular knitting machine, an improved construction of said needles for reducing the impact forces in the needles, wherein each of the needles has a laterally bulging pre-sprung portion in the shank at the location of the butt which is at least coextensive therewith, the lateral bulging of said pre-sprung portion in the shank including the entire cross-section of the needle shank including the butt and being in the direction of rotation of the needle carrier, the width of said tricks exceeding the stock width of said shanks, whereby the bulging portion of the needle shank is in sliding contact with the confronting first lateral side wall of the respective trick portions of said shank spaced in opposite directions axially of said shank from said laterally bulging pre-sprung portion being in sliding contact with the side wall of the respective trick opposite said first lateral side wall.

* * * * *